US005342062A

United States Patent [19]

Lance

[11] Patent Number: 5,342,062

[45] Date of Patent: Aug. 30, 1994

[54] GALLERY, SILHOUETTE, AND TARGET SYSTEM WHICH IS EASILY RESETTABLE, COLLAPSIBLE, AND PORTABLE

[75] Inventor: Alan G. Lance, Meridian, Id.

[73] Assignee: Lance Land & Livestock Ltd., Meridian, Id.

[21] Appl. No.: 991,960

[22] Filed: Dec. 17, 1992

[51] Int. Cl.[5] ..... F41J 5/18

[52] U.S. Cl. ..... 273/391

[58] Field of Search ..... 273/389, 380, 391, 392, 273/410, 388

[56] References Cited

U.S. PATENT DOCUMENTS

| | | | |
|---|---|---|---|
| 910,608 | 1/1909 | Thompson et al. | 273/391 |
| 951,377 | 3/1910 | Metzger | 273/391 |
| 1,240,394 | 9/1917 | Wesley | 273/391 |
| 1,528,662 | 3/1925 | Ewing | 273/391 |
| 1,733,606 | 10/1929 | Junker | 273/391 |
| 3,064,976 | 11/1962 | Kuhn | 273/391 |
| 3,197,207 | 7/1965 | Sanzare | 273/410 |
| 3,411,784 | 11/1968 | Lawrence | 273/392 |
| 4,524,976 | 6/1985 | Seitz et al. | 273/391 |
| 4,550,918 | 11/1985 | Motsenbocker | 273/391 |
| 4,588,194 | 5/1986 | Steidle et al. | 273/391 |

*Primary Examiner*—Mark S. Graham

*Attorney, Agent, or Firm*—Frank J. Dykas; Craig M. Korfanta

[57] ABSTRACT

A multiple option gallery, silhouette and target system having a remotely resettable silhouette or other target support apparatus which is operative to reset the target system merely by the pull of a small rope or cord. The apparatus includes a reset moment arm member and a reset bracket which are joined together and operable to simultaneously rotate as a unitary member about the longitudinal axis of a cross bar member when the rope or cord is pulled against the reset moment arm member. This motion forces the reset bracket against a plurality of silhouette target support posts which are also rotatably mounted on the cross bar member. This target system also includes the use of variable size disposable ring targets, horizontally movable permanent metal targets, or optional suspended silhouette targets and windage and elevation vericator targets useful to calibrate for wind shifts and temperature changes during a target practice session.

8 Claims, 8 Drawing Sheets

GALLERY, SILHOUETTE, AND TARGET SYSTEM WHICH IS EASILY RESETTABLE, COLLAPSIBLE, AND PORTABLE

TECHNICAL FIELD

This invention relates generally to targets for pellet shooting air and $CO_2$ rifles and the like and more particularly to such a target which maximizes functionality, versatility, and available target options with a minimum number of moving parts.

BACKGROUND ART

Various types of target systems have been designed over the years and offer the shooter of pellet shooting air and $CO_2$ rifles some variety of target types and sizes and a number of different target reset features. These target reset features enable the shooter to return the target to a normal upright position once it has been hit by a pellet or projectile. These prior art target systems are not, generally speaking, easily, rapidly, and reliably resettable from a location remote from the target. In addition, these prior art target systems do not offer the shooter a wide variety of target options in an apparatus which is readily collapsible, portable, economical in construction, and multipurpose in function.

SUMMARY OF INVENTION

The general purpose and principal object of the present invention is to provide a new and improved gallery, silhouette, and target system for pellet shooting air and $CO_2$ rifle shooters which is, in fact, easily, rapidly, and reliably resettable from a remote location, while simultaneously offering the shooter a wide variety of target options in an apparatus which is readily collapsible, portable, economical in construction, and multipurpose in function.

Another object of this invention is to provide a new and improved target system and apparatus of the type described which is reliable in operation, durable in construction, and which offers a high price/performance FIGURE of merit.

Another object of this invention is to provide a new and improved target system and apparatus of the type described which may be readily constructed using conventional, inexpensive off the shelf components and parts.

Briefly described, the present invention is directed to a multiple option remote-resettable target for use with pellet shooting air and $CO_2$ rifles and the like and includes, in combination: support means including a pair of upstanding frame pieces between which extends an intermediate horizontal cross bar. This cross bar is mounted and supported at each of the frame pieces, and a plurality of target support posts are rotatably secured to this intermediate horizontal cross bar. A reset moment arm member is joined to a target reset bracket member, and both of these members are rotatably mounted on the intermediate horizontal cross bar. An upper horizontal cross bar is mounted above the intermediate horizonal cross bar, so that when a pull force is exerted on the reset moment arm member, this force causes the reset bracket member to rotate, thereby also rotating the plurality of target support posts to bring the target support posts to an upright position against the upper horizontal cross bar in preparation for target practice.

A novel feature of this invention is the provision of a new and improved target system and apparatus of the type described which further includes a plurality of reusable silhouette targets received, respectively, on each of the above plurality of target support posts.

Another feature of this invention is the provision of a new and improved target system and apparatus of the type described which further includes a protective front plate secured to the upper horizontal cross bar and to the pair of upstanding frame pieces. One or more magnets are used for securing disposable ring targets to the front plate. Advantageously, horizontal and vertical bars or sleeves may be hung from the top edge of this bullet-protective front plate, and they allow a shooter to periodically calibrate for wind shifts and temperature changes which may cause the shooter's aim to drift horizontally or vertically with respect to the point of aim.

Another feature of this invention is the provision of a new and improved target system and apparatus of the type described wherein the means for securing the ring target includes a vertically adjustable metal strip extending between the pair of vertical frame members, so that variable length display ring targets may be mounted between the front plate and this vertically adjustable strip.

Another feature of this invention is the provision of a new and improved target system and apparatus of the type described which further includes a rod extending between the pair of upstanding frame pieces. This rod includes a loop mounted thereon for receiving a pull rope or cord which extends between the reset moment arm member and the remote location of the shooter. Here a shooter may easily reset the target by pulling on the rope or cord, exerting a force on the reset moment arm member and thereby causing the reset bracket to be rotated against the above plurality of target support posts to bring the target support posts back into an upright position and ready for another target practice session. In addition, one or more additional metal targets may be slideably mounted on this multifunctional rod to further expand the target options of the system and apparatus described herein.

The above brief summary of the invention, together with its many attendant advantages and novel features, will become better understood with reference to the following description of the accompanying drawings.

DESCRIPTION OF THE PREFERRED EMBODIMENT

Figure 1:
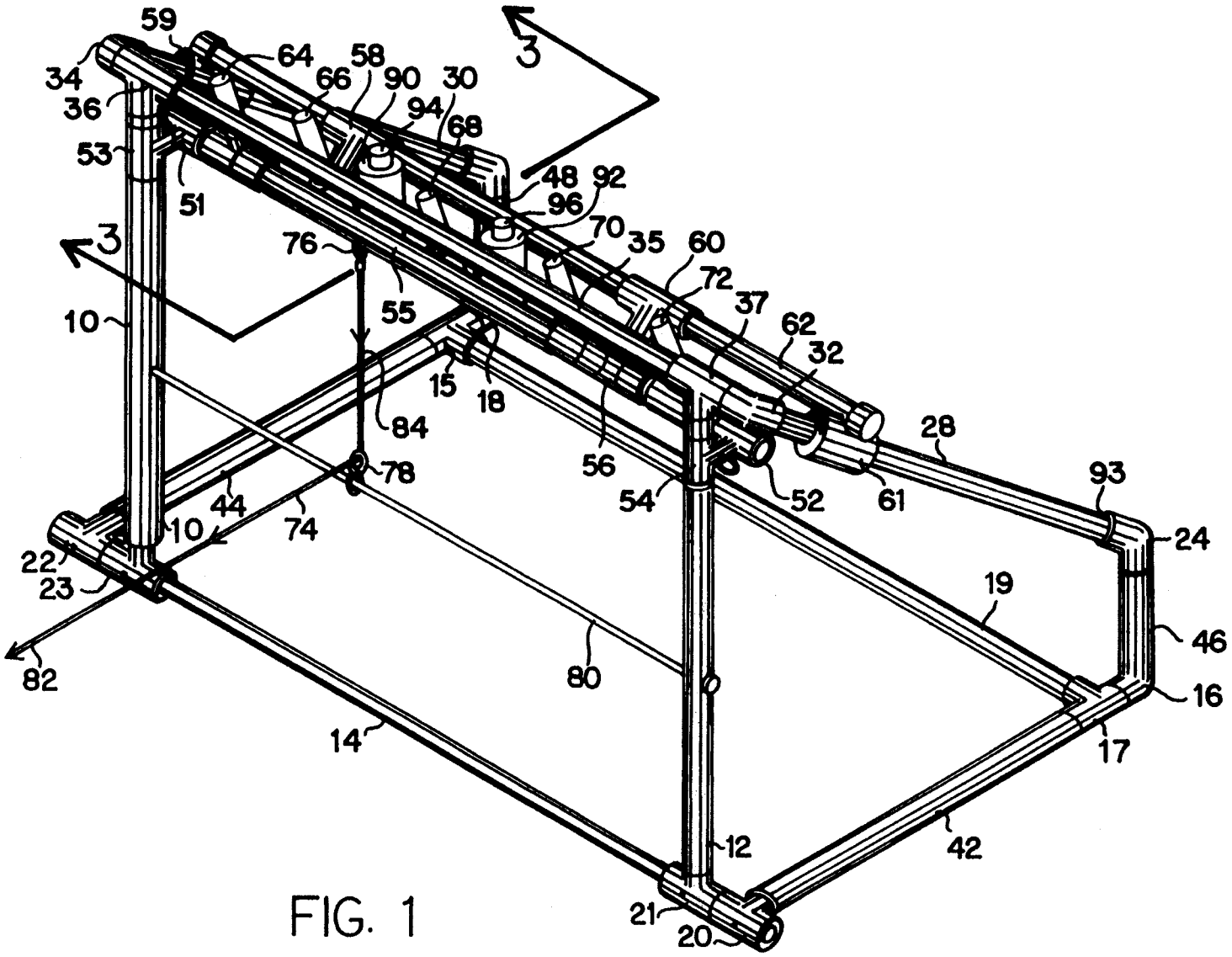
FIG. 1 is a perspective view showing the basic target support and control apparatus without the targets and bullet-protective front plates mounted thereon in order to fully explain the mechanical and functional aspects of target resettability.

Referring now to FIG. 1, there is shown in perspective view the basic target support apparatus without the various types of targets and pellet protective plates mounted thereon, and this apparatus includes a pair of upstanding cylindrical frame members 10 and 12 which are rotatably secured to a lower cross bar member 14. The lower cross bar member 14 is in turn joined to a pair of floor support frame members 16 and 18 which are rotatably mounted on the lower cross bar member 14 by means of the T-shaped end fixtures 20 and 22, and thus form the floor support for the target apparatus. Each of the rearwardly extending floor support bars 16 and 18 are rotatably joined to the vertical rear frame members 24 and 26, and the vertical rear frame members 24 and 26 are, in turn, connected to receive, respectively, a pair of angled frame pieces 28 and 30.

The angled frame pieces 28 and 30 have right angle end fixtures 32 and 34 thereon which are, in turn, insertable over the ends of the upper horizontal cross bar 35 which extends into the T-shaped end fixtures 36 and 37. These T-shaped end fixtures also fit as shown on each upper end of the two vertical frame pieces 10 and 12. A horizontal support bar 19 is mounted as shown between the two T-shaped side fixtures 15 and 17 to provide horizontal rear support for the target system in FIG. 1. An intermediate cross bar 50 is secured to a pair of T-shaped end fixtures 51 and 52 which are, in turn, removably inserted into the mating T-shaped fixtures 53 and 54. These fixtures 53 and 54 are fixed to the vertical frame pieces 10 and 12. An outwardly extending reset moment arm member 55 is joined at right angle fixtures 56 and 57 to a target reset bracket which comprises a pair of T-shaped fixtures 58 and 60 through which a main horizontal reset bracket bar 62 extends.

A plurality of target support posts 64, 66, 68, 70, and 72 are rotatably secured to the intermediate cross bar member 50, and these target support posts are brought to the upright position shown in FIG. 1 by a pull on the string, small rope, wire, or cord 74 which is secured by the screw 76 to the outwardly extending reset moment arm member 55. The cord 74 further extends through a loop member 78 which is attached to a horizontal rod 80, and it then further extends in the direction of the arrow 82 to a remote location where the target shooter is located. Thus, by gently pulling on the cord 74, there will be produced a downward pull force in the direction of the arrow 84 so as to rotate the reset moment arm member 55 downwardly, thereby in turn rotating the reset bracket comprising members 58, 60, and 62 in the direction of arrows 86 and 88. This motion, in turn, will operate to bring the plurality of target support posts 64, 66, 68, 70, and 72 to an upright position.

Simultaneously, the main cross bar 62 of the reset bracket will come to rest on the cylindrical foam cushions 90 and 92 which surround the intermediate shock absorbing posts 94 and 96, respectively, in order to provide shock and noise reduction in the reset operation of the target. Then, when the pull cord 74 is released, the reset moment arm 55 rotates back against the intermediate posts 94 and 96 to return these posts and their respective outer cushions 90 and 92 to the laid back position shown in FIG. 3 and described in more detail below.

Figure 2:
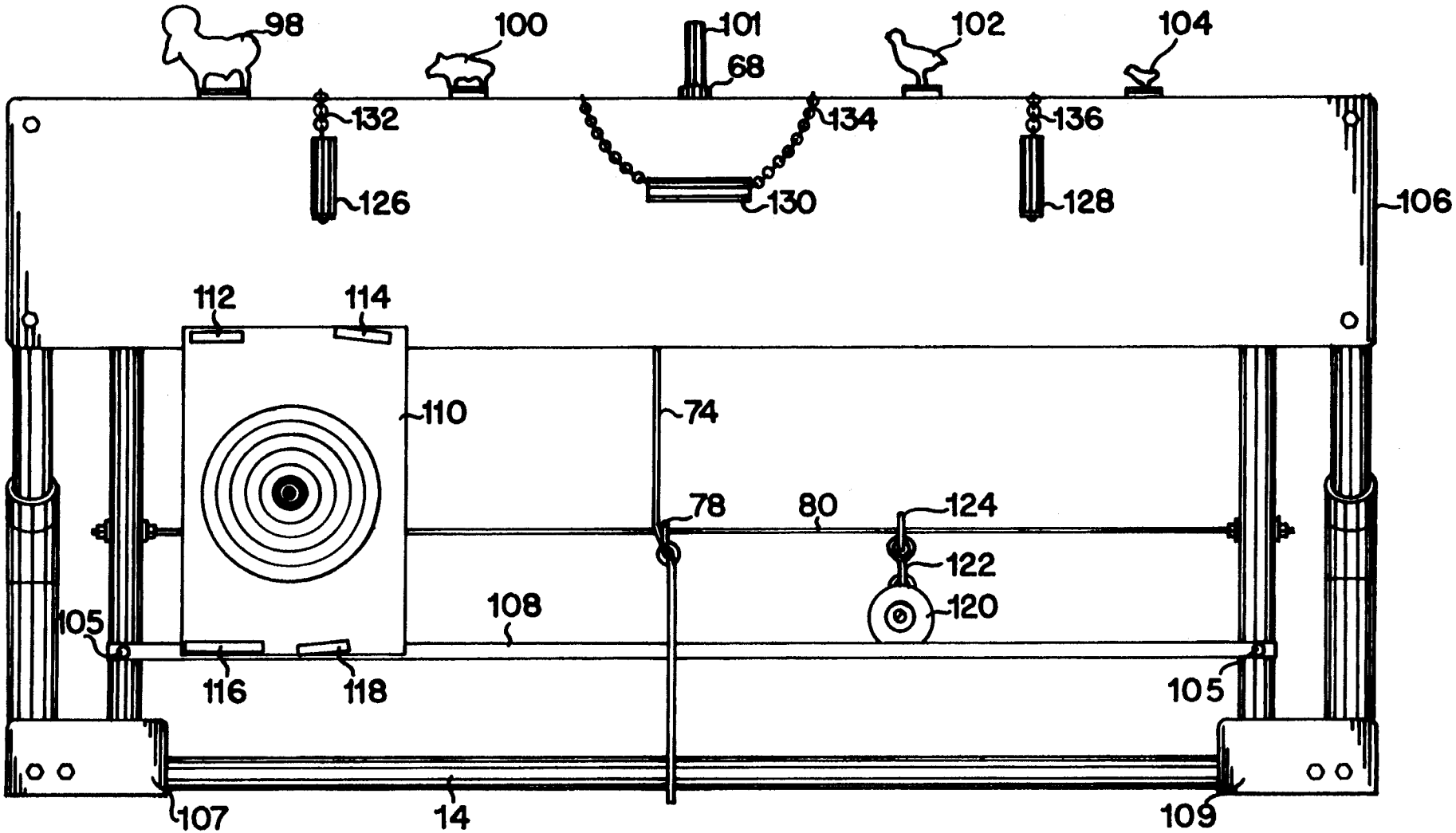
FIG. 2 is a front elevation view showing the upper and lower pellet protective front plates set in place and also showing the three types of targets plus the calibration sleeves or bars, all set in place in preparation for a target practice session.

A $\frac{1}{8}'' \times \frac{3}{4}''$ horizontal free standing silhouette platform (not shown) is extended and mounted on the top of the top angular joints 36 and 37 in FIG. 1 and flush with the front upper pellet protective plate 106 in FIG. 2. This platform base is utilized for the placement of "free standing" silhouette targets for silhouette competition shooting in accordance with NRA Official Rules. One end of this horizontal platform is designated by the reference numeral 67 in FIG. 6 described below.

When it is desired to fold up and collapse the apparatus shown in FIG. 1 and in preparation for insertion of the target apparatus into an easily portable rectangular box, the unitary structure comprising: the reset moment arm 55, the right angle T-shaped fixtures 56 and 57, the mating T-shaped fixtures 58 and 60 of the reset bracket, the elongated horizontal reset arm 62 of the reset bracket and the intermediate cross bar 50 is removed from the remaining structure described above upon the rearward pull of the T-shaped fixtures 51 and 52 away from the mating T-shaped fixtures 53 and 54 located on each of the upstanding frame members 10 and 12 as viewed in FIG. 1. This motion allows the reset moment arm 55 and the reset bracket 58, 60, and 62 to be removed from the remainder of the structure shown in FIG. 1 in preparation for storage.

Also in preparation for storage is the ability to remove the angled arms 28 from the rear frame pieces 24 at the joints 93, thereby enabling the angled arms 26 and 28 on each side of the structure to be rotated toward the frame pieces 10 and 12 and in the direction of arrow 95, simultaneously enabling the rear frame members 24 and 26 to be laid down on the supporting floor in the direction of arrow 97. This movement then allows the arms 26 and 28, together with the upstanding frame pieces 10 and 12, to be rotated at the lower fixtures 21 and 23 in the direction of arrow 99, so as to fold the above described supporting frame pieces substantially into the plane of the floor, neglecting the thickness dimensions of the various frame pieces and the fixtures which join these frame pieces.

Referring now to FIG. 2, a plurality of silhouette targets 98, 100, 102, and 104 are secured to the tops of the previously identified upstanding target support posts 64, 66, 70, and 72 in FIG. 1. These target support posts 64, 66, 70, and 72 are shielded in FIG. 2 by the provision of a rectangular shaped upper bullet protective metal front plate 106 which is secured to the vertical frame members 10 and 12 in FIG. 1. Smaller lower protective metal front plates 107 and 109 are mounted at the lower corner sections of the target where the vertical frame pieces 10 and 12 are joined to the lower horizontal support bar 14. In addition to the four silhouette targets 98, 100, 102, and 104, and to add some additional target variety at the upper target level in FIG. 2, a center target post or cylinder 101 is inserted into the central target support post 68 at the center of the silhouette array.

The silhouette targets 98, 100, 102, and 104 may, for example, be in the shape of animals such as a ram (98), a pig (100), a turkey (102), and a chicken (104). The larger these animals become, and in accordance with National Rifle Association (NRA) marksmanship rules, the greater the distance will become between the shooter and target. For example, the shooter's distance from the chicken 104 will be twenty (20) yards; the shooter's distance from the turkey will be thirty-six (36) yards; the shooter's distance from the small pig will be thirty (30) yards; and the shooter's distance from the larger ram will be forty-five (45) yards. Thus, in accordance with the present invention, the above described target assembly is maintained at a stationary location, whereas the target shooter may easily move about to any of these required distances from the target where he is able to reset the target at any of these different locations merely by a light pull on the target reset string or cord 74 as previously described. Advantageously, the cord 74 may be wound on a reel such as a spinning reel used for fishing where the cord 74 may be easily let out, taken up, or locked into place for a pull on the cord during a target reset operation.

The completely assembled target as shown in FIG. 2 further includes a vertically adjustable horizontal metal strip 108 which is used to help secure a disposable ring type target 110 between the upper rectangular protective plate 106 and the metal strip 108 by means of a plurality of small magnets or magnetic strips 112, 114, 116, and 118. In addition, and to further provide the target shooter with yet a third target option, one or more additional smaller cylindrical metal targets 120 may be slideably mounted as shown in the loop and ring fixtures 122 and 124 and suspended as shown from the previously identified rod 80. A small loop member 78 is also secured to the rod 80 for receiving the cord 74 therethrough in the direction of arrows 82 and 84 in FIG. 1 and back to the location of the target shooter.

Further, with regard to the size adjustability of the disposable ring target 110, this target 110 is shown in FIG. 2 at typically the 9½ inch length dimension with the metal strip 108 in the position shown. However, the metal strip 108 may be easily removed by unloosening the screws 105 and 107 on each end of the metal strip 108, thereby allowing the metal strip 108 to drop down behind the two lower protective plates 107 and 109 in a position where a larger 12½ inch length targets (official NRAair rifle competition target size) may now be mounted between the upper front protective plate 106 and the lower cross bar 14.

Finally, the target assembly in FIG. 2 includes a pair of windage vericator or calibration targets 126 and 128 in the form of vertical metal cylinders and a horizontal elevation calibrator target 130, all suspended over the upper edge of the protective front plate 106 by either wires or small chains 132, 134, and 136. The use of windage calibration targets 126 and 128 is a field expedient to determine whether the air rifle windage adjustment is accurately set to within 0.5 to 1.0 inches of the point of aim, left-to-right or right-to-left. Similarly, the elevation calibration target 130 is a field expedient to determine whether the air rifle elevation adjustment is accurately set to within 0.5 to 1.0 inches of the point of aim, up-to-down or down-to-up.

The above described calibration verification is desirable when shooting non-paper targets and where the point of impact of the pellet is not recorded. A change in cross winds conditions, temperature, and/or humidity during a shooting session may necessitate a re-calibration of the air rifle sighting apparatus, and these field expedients assist the rifle shooter in rapidly identifying which calibration (windage or elevation or both) needs to be re-calibrated as a result of a change in shooting conditions.

Figure 3:
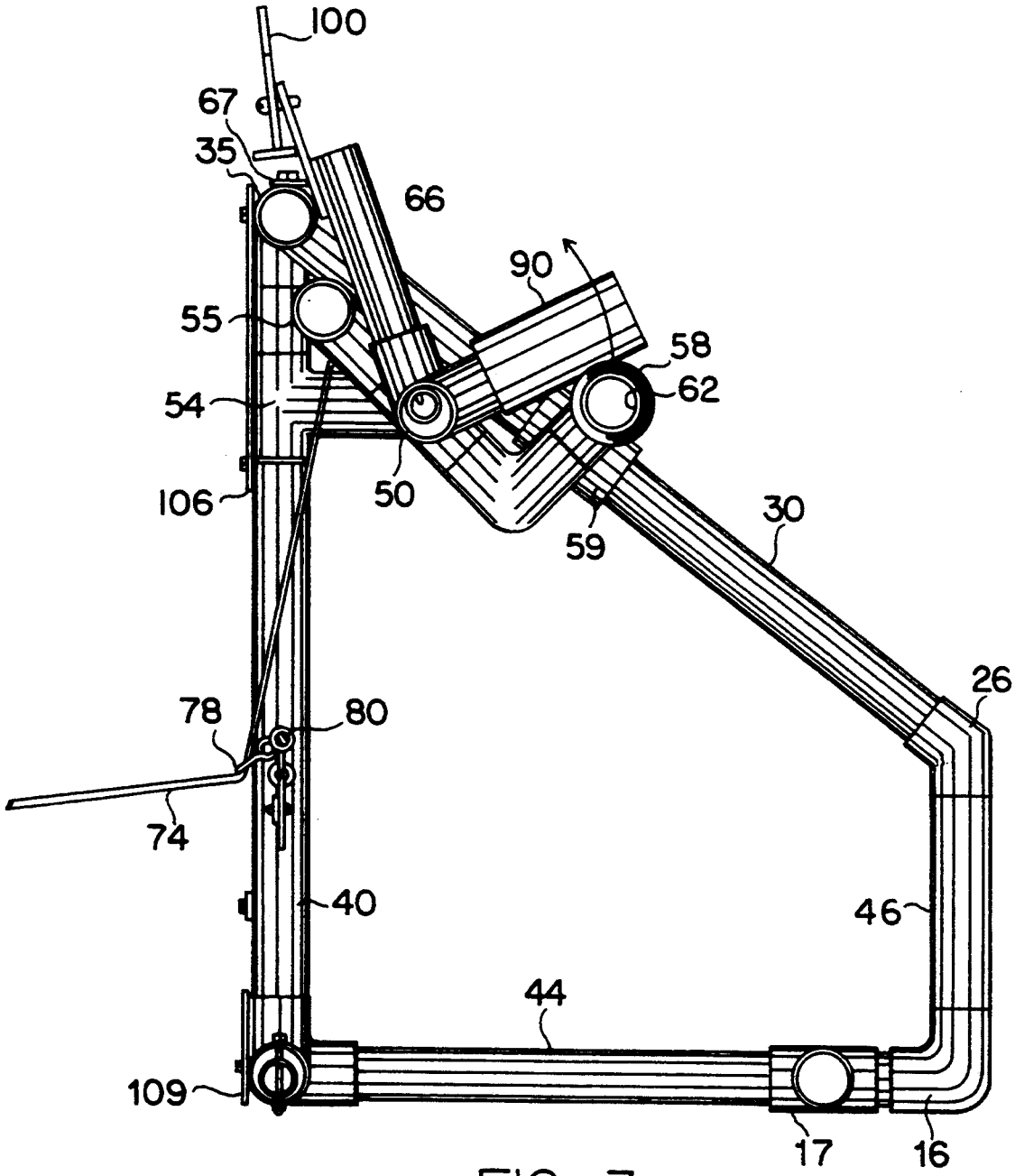
FIG. 3 is a side elevational view taken along lines 3—3 of FIG. 1 and showing the target support posts in an upright position, with the silhouettes positioned thereon in preparation for a target practice session.

Referring now to FIG. 3, there is shown an elevation view looking into the plane of arrows 3—3 of FIG. 1, and wherein all the reference numerals shown in FIG. 3 correspond to like components in FIGS. 1 and 2 above. The target support post 66 which carries the pig's silhouette 100 leans onto the upper horizontal cross bar 35 at approximately the eleven o' clock position. When the cord 74 was released by the target shooter, the reset moment arm 55 was allowed to rotate upwardly in a clockwise position as viewed in FIG. 3 to thereby strike the foam cushion 90 (as viewed in its FIG. 1 position) to knock the foam cushion 90 and the supporting target post 94 which it surrounds in the laid back position as shown and coming to rest on the reset bracket member 62 and its outer cushion 58. This action is partially the result of gravity and partially due to the bouncing motion of the reset bracket when the shooter pulls on the cord 74 to provide first a rapid forward motion of the reset bracket and adjoined moment art and then a rebounding motion towards its laid back position shown in FIG. 3. Also, in the background of the FIG. 3 view can be seen the left side angled frame member 30 and the small cylindrical cushion 59 thereon upon which the reset bracket cross bar 62 has come to rest in this laid back position.

Figure 4A:
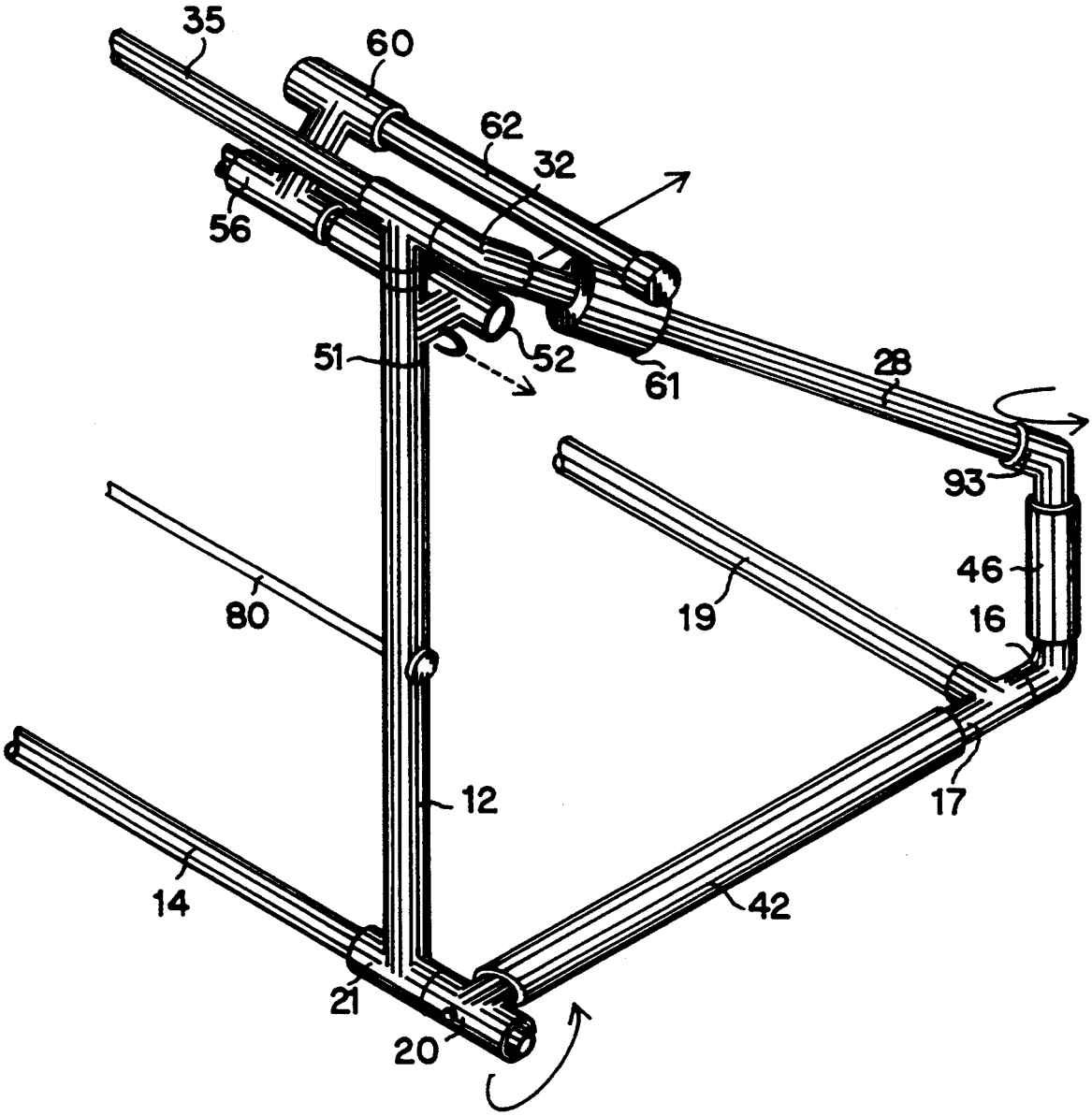
FIGS. 4A and 4B are enlarged fragmented perspective views of the right side end section of FIG. 1 showing both the removal of the reset bracket and moment arm members from the remaining main frame members of the target apparatus and the collapsing motion for the main frame support members for transfer to a portable box.
Figure 4B:
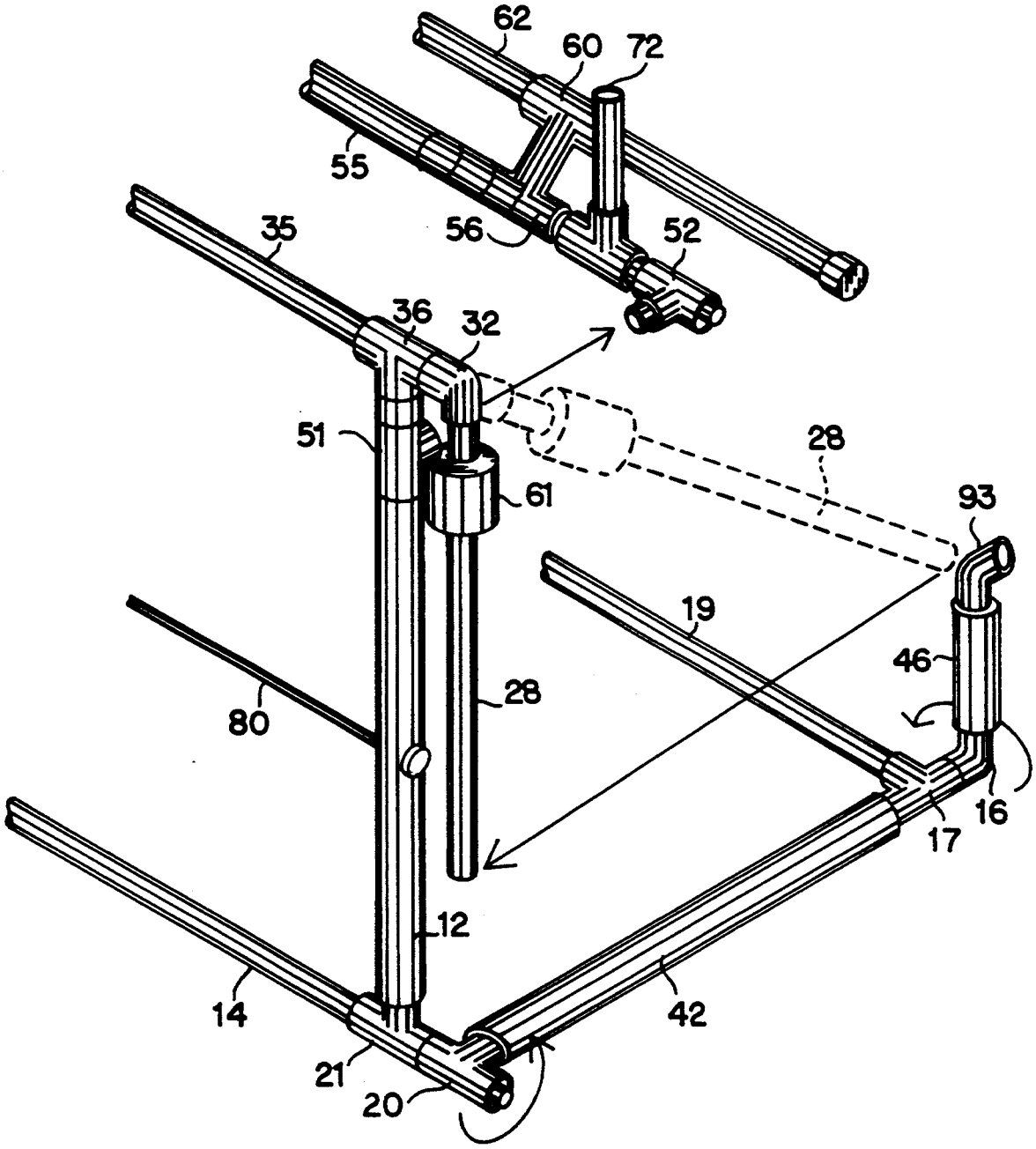
Figure 4C:
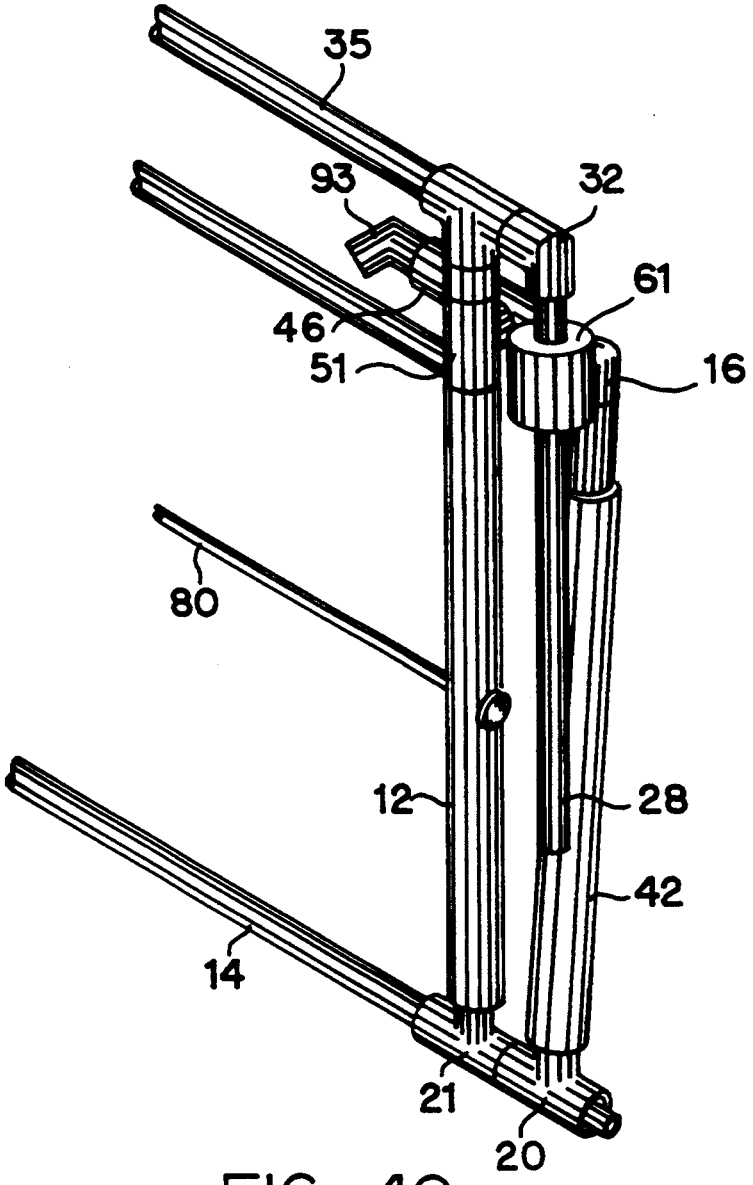
FIG. 4C is an enlarged fragmented perspective view of the collapsed main frame support members shown in the above FIGURES.

Referring now in sequence to FIGS. 4A, 4B, and 4C, the fragmented perspective view in FIG. 4A more clearly shows how the T-shaped mating fixtures 51 and 52 serve to secure the reset bracket member including the T-shaped fixtures 56 and 60 and the reset bracket arm 62 to the main upstanding end frame piece 40. This vertical frame piece 40 is in turn secured to the lower cross bar member 14 by means of the T-shaped fixture 21, and the end frame piece 16 with a covering 42 thereon is secured to the cross bar 14 by means of the outer T-shaped end fixture 20. The remaining components identified numerically in FIG. 4A correspond identically to the same reference numerals shown in FIG. 1.

Referring now to FIG. 4B, the angled frame piece 28 and its cylindrical pad 61 which receives the reset bracket arm 62 in FIG. 1 has now been rotated to its vertical position from its previous dotted line position shown in FIG. 2A. The reset bracket member including the fixtures 56, 60, and reset bracket arm 62 which are joined to the reset moment art 55 have now been withdrawn from the main frame piece by removing the T-shaped fixture 52 from the mating T-shaped fixture 51 on the vertical frame piece 40.

Figure 5:
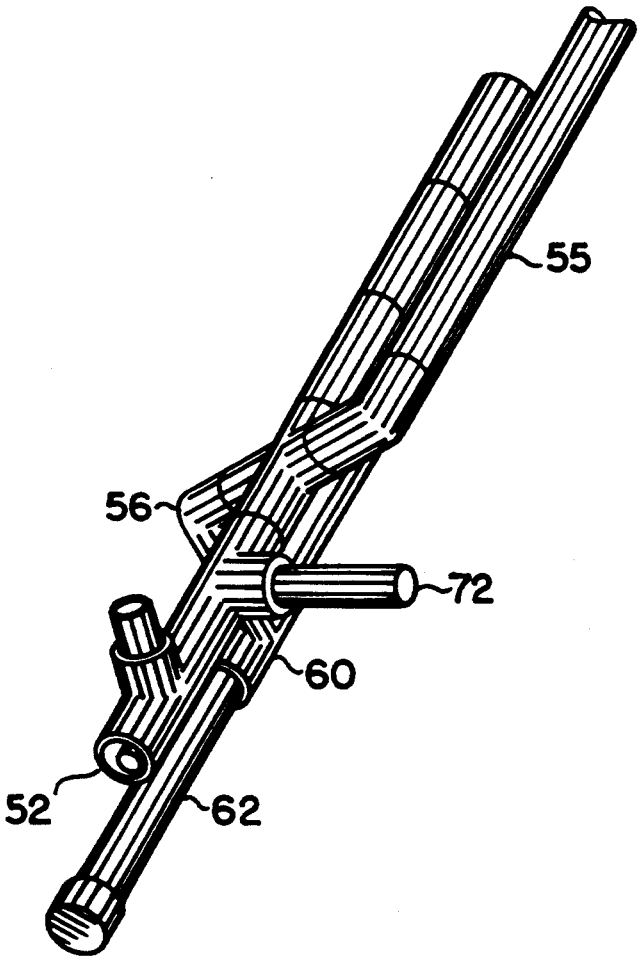
FIG. 5 is an enlarged fragmented perspective view of the collapsed reset bracket and moment arm in the above FIGURES.

Referring now to FIG. 4C, all of the frame pieces 40, 28, and 42 can be rotated toward a single vertical plane, and likewise the reset bracket and moment arm member can be folded to the position shown in FIG. 5 and in preparation for insertion into a box or carrying case.

Figure 6:
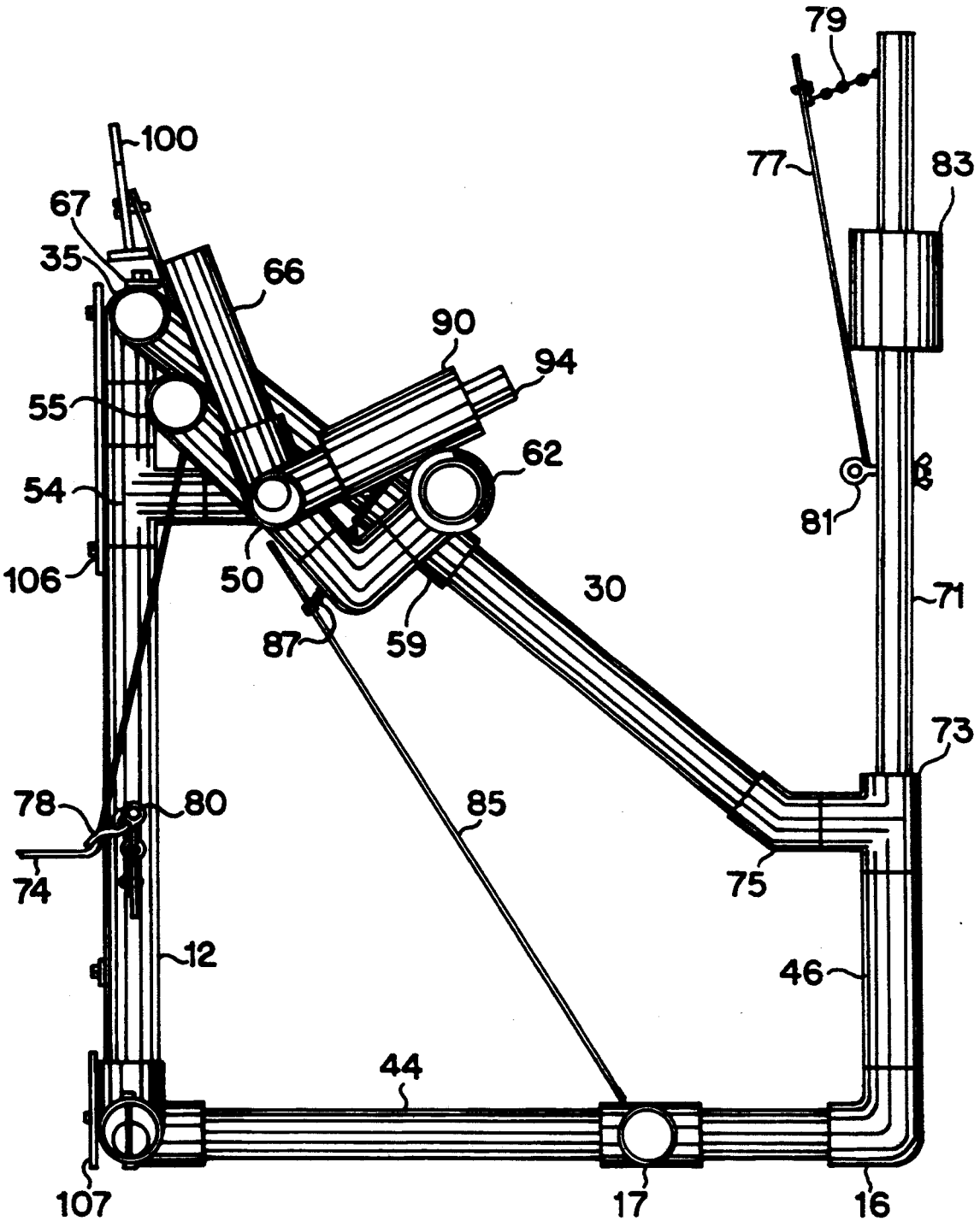
FIG. 6 shows an alternative embodiment of the invention in which upper and lower bullet traps have been added to enhance the safety of operation of the target system.

Referring now to FIG. 6, this view shows a modification of the view in FIG. 3 and includes, in addition to the common structural components with FIG. 3 for which like reference numerals designate identical components, an upstanding rear frame member 71 which is received in a T-shaped joint 73. The angled joint 75 is now reversed in orientation with respect to the orientation of joint 26 in FIG. 3, and an upper bullet trap 77 is suspended as shown between a chain 79 and a bolt 81. A cylindrical cushion 83 surrounds the vertical frame piece 71 and restrains the rearward movement of the upper bullet trap 77.

A lower bullet trap 85 is suspended in the angled position shown by a chain 87, and both the upper and lower bullet traps 77 and 85 provide a desirable shielding in the upper and lower areas of the target system for errant pellets fired too high or too low with respect to the various target locations shown in FIG. 2, or for ricocheting pellets or for pellets fired into the sized paper targets or targets suspended from a horizontal cross bar These bullet or pellet traps 77 and 85 are made of sixteen (16) gauge steel, and positioned in the angled position shown provide excellent energy absorption for pellets typically of 0,177–0.25 calibre in size and travelling at a muzzle velocity of up to 1000 feet per second.

In addition to the added safety measure provided by these two bullet traps 77 and 85, these traps serve to contain stray bullets or pellets in a given area, and pellets fired into the paper and hanging targets as described above, for containment and recycling of the lead, thus enhancing the environmental aspects of the target system.

Various modifications may be made in and to the above described preferred embodiment without departing from the spirit and scope of this invention. Accordingly, such modifications in areas of apparatus size, shape, materials, and types of multiple targets used are clearly within the scope of the following appended claims.

I claims:

1. A multiple option target for use with pellet shooting air and $CO_2$ rifles, including, in combination:

a. a pair of upstanding frame pieces between which extends an intermediate horizontal cross bar mounted at each of said frame pieces, b. a plurality of target support posts rotatably secured to said intermediate cross bar, c. a reset moment arm member joined to a target reset bracket, both of which are rotatably mounted on said intermediate cross bar, and d. an upper horizontal cross bar mounted above said intermediate horizontal cross bar, wherein a pull force on said reset moment arm member will cause said target reset bracket to rotate and thereby urge said target support posts against said upper horizontal cross bar member to bring said target support posts to an upright position against said upper cross bar in preparation for a target practice session.

2. The target defined in claim 1 which further includes a plurality of reusable silhouette or other targets received, respectively, on said plurality of target support posts.

3. The target defined in claim 2 which further includes:

a. an upper protective front plate secured to said pair of upstanding frame members, and b. means for securing disposable ring targets to said front plate.

4. The target defined in claim 3 wherein said target securing means includes a vertically adjustable horizontal strip extending between said vertical frame members, so that variable length disposable ring targets may be mounted between said front plate and said vertically adjustable strip.

5. The target defined in claim 4 which further includes:

a. a rod extending between said pair of upstanding frame pieces, and b. a loop mounted on said rod and receiving therethrough a flexible cord which extends between said reset moment arm member and a remote location where a shooter may pull on said flexible cord and rotate said reset bracket of said target to bring said plurality of target support posts to an upright position.

6. A multiple option target for use with pellet shooting air and $CO_2$ rifles including, in combination:

a. an upstanding support means having an intermediate horizontal cross bar mounted thereon for rotatably supporting a plurality of target support posts to which silhouette or other targets are secured;

b. a rod attached to said upstanding support means, c. a plurality of target support posts rotatably secured to said intermediate cross bar;

d. a reset moment arm member joined to a target reset bracket, both of which are rotatably mounted on said intermediate cross bar;

e. an upper horizontal cross bar mounted above said intermediate horizontal cross bar, wherein a pull force on said reset moment arm member will cause said target reset bracket to rotate and thereby urge said target support posts against said upper horizontal cross bar member to bring said target support posts to an upright position against said upper cross bar and thereby vertically position said silhouette or other targets just above said protective front plate in preparation for a target practice session;

f. a loop mounted on said rod for receiving there through a flexible cord extending between said front plate and said remote location where a shooter may pull on said flexible cord to bring said target support posts to an upright position;

g. a protective front plate secured to said upstanding support means, and h. means for securing disposable ring targets to said front plate wherein said target securing means includes a vertically adjustable strip attached to said upstanding support means so that variable length disposable ring targets may be mounted between said front plate and said vertically adjustable strip.

7. The target defined in claim 6 which further includes one or more additional targets slidably mounted on said rod.

8. The target defined in claim 6 wherein said upstanding support means includes a pair of vertical frame members between which said intermediate and upper cross bars extend, whereby said protective front plate is positioned to cover and protect said upper and intermediate cross bars, said target support posts, said reset moment arm and said reset bracket during target practice.

* * * * *